US010543981B2

(12) United States Patent
Adams et al.

(10) Patent No.: US 10,543,981 B2
(45) Date of Patent: Jan. 28, 2020

(54) FORKLIFT BIN

(71) Applicant: Toyota Motor Engineering & Manufacturing North America, Inc., Erlanger, KY (US)

(72) Inventors: Brendt A. Adams, Long Beach, CA (US); Ely Ramirez, Moreno Valley, CA (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 397 days.

(21) Appl. No.: 14/517,665

(22) Filed: Oct. 17, 2014

(65) Prior Publication Data

US 2016/0107834 A1 Apr. 21, 2016

(51) Int. Cl.
*B65F 1/12* (2006.01)

(52) U.S. Cl.
CPC ..... *B65F 1/122* (2013.01)

(58) Field of Classification Search
CPC ..... B65F 1/122; B65F 3/26; B65F 1/1615; B65F 1/1623; B65F 2001/1653; B65F 2001/1669; B65F 2001/1692; B65D 88/56; B65D 88/127; B65D 88/542; B65D 88/58; B65D 90/0086; B65D 90/623; E05B 15/0093; E05B 2047/0078; B66F 9/19; B60P 1/28; B60P 1/286; B60P 1/283; B62D 33/023; Y10T 292/0937; Y10T 292/0938; Y10T 292/1006; Y10T 292/1063
USPC ..... 298/9; 292/183–189, 130–136, 230–239, 292/251.5; 177/110; 220/230; 414/411, 414/414; 296/183.2; 294/68.26
See application file for complete search history.

(56) References Cited

U.S. PATENT DOCUMENTS 3,796,349 A * 3/1974 Weber ..... B65D 90/54 177/114
4,155,584 A * 5/1979 Pracchia ..... B65F 1/1615 294/68.1
4,180,177 A * 12/1979 Gunderman ..... A62C 3/00 220/230
4,275,830 A 6/1981 McDonald
4,328,901 A * 5/1982 Gunderman ..... B65D 90/34 220/371
5,288,195 A * 2/1994 McIntyre ..... B66F 9/02 110/165 R
5,511,682 A * 4/1996 Pace ..... B65F 1/06 220/230

(Continued)

FOREIGN PATENT DOCUMENTS

DE 9319317 U1 * 8/1994 ..... A01F 25/14
EP 2388208 A2 * 11/2011 ..... B65D 88/125

(Continued)

OTHER PUBLICATIONS

9319317DEU1.tran.pdf.*
Goubard, Tipping Skip with Front Door, Undated, in 1 page.
Digga, Mini Dump Bin, www.digga.com, Undated, in 1 page.

*Primary Examiner* — Allan D Stevens
(74) *Attorney, Agent, or Firm* — Christopher G. Darrow; Darrow Mustafa PC

(57) ABSTRACT

A forklift bin includes a container affixed to a frame. The container includes a bottom sloped with respect to a swing door. The swing door can be retained via magnets.

17 Claims, 3 Drawing Sheets

(56) References Cited

U.S. PATENT DOCUMENTS

| | | | | |
|---|---|---|---|---|
| 5,607,140 | A * | 3/1997 | Short, III | F16K 1/226 251/305 |
| 5,951,230 | A | 9/1999 | Kruzick et al. | |
| 6,533,122 | B1 * | 3/2003 | Plunkett | B65D 19/12 206/600 |
| 8,403,617 | B2 * | 3/2013 | Banning | B65F 1/12 414/422 |
| 2013/0318930 | A1 | 12/2013 | Deng et al. | |

FOREIGN PATENT DOCUMENTS

| | | | | |
|---|---|---|---|---|
| FR | 1188989 | A * | 9/1959 | B65D 88/56 |
| GB | 2031845 | A * | 4/1980 | B65D 88/56 |

* cited by examiner

FORKLIFT BIN

BACKGROUND

The present disclosure relates to a forklift bin, and more particularly, to a forklift bin that facilitates safe operation.

A forklift bin is frequently used inside manufacturing facilities to facilitate the transport of various materials. They may be of varying dimensions and are typically adapted for handling by a forklift.

Oftentimes the materials conveyed in the forklift bin, such as scrap, trash, or even manufactured products, are relatively heavy weight materials such that safe handing thereof is of paramount importance.

SUMMARY

The forklift bin described herein can be used to facilitate retention of, and the safe handling of, relatively heavy weight materials contained therein. The forklift bin includes a swing door and a bottom sloped away therefrom such that materials dispensed thereby will slide out when the swing door opens in a directed flow pattern. The swing door can be magnetically retained.

A forklift bin according to one disclosed non-limiting embodiment includes a container affixed to a frame, the container including a bottom sloped downward with respect to a swing door.

A forklift bin according to another disclosed non-limiting embodiment includes a frame including a first forklift opening and a second forklift opening. A container is affixed to the frame and includes a back wall between a first sidewall and a second sidewall, a bottom between the first sidewall, the second sidewall and the back wall, and a swing door opposite the back wall. The swing door is adjacent to a high side of the bottom.

A forklift bin according to another disclosed non-limiting embodiment includes a frame including a first forklift opening and a second forklift opening. A swing door is pivotally mounted to the frame adjacent to a high side of a bottom.

The foregoing features and elements may be combined in various combinations without exclusivity, unless expressly indicated otherwise. These features and elements as well as the operation thereof, will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

A forklift bin is disclosed. The forklift bin has a swing door and a bottom sloped away from the swing door such that materials dispensed thereby will slide out in a directed flow pattern. The forklift bin thereby facilitates retention of materials within an open top container, and thus the safe handling of relatively heavy weight materials contained therein.

Figure 1:
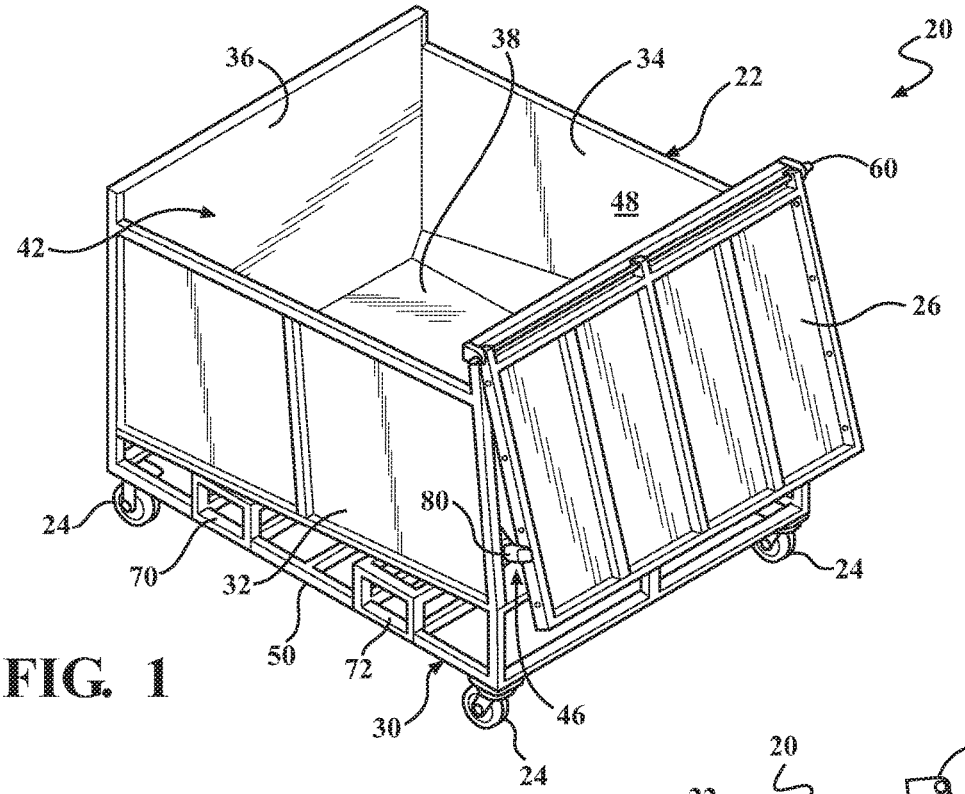
FIG. 1 is a schematic perspective view of a forklift bin.
Figure 2:
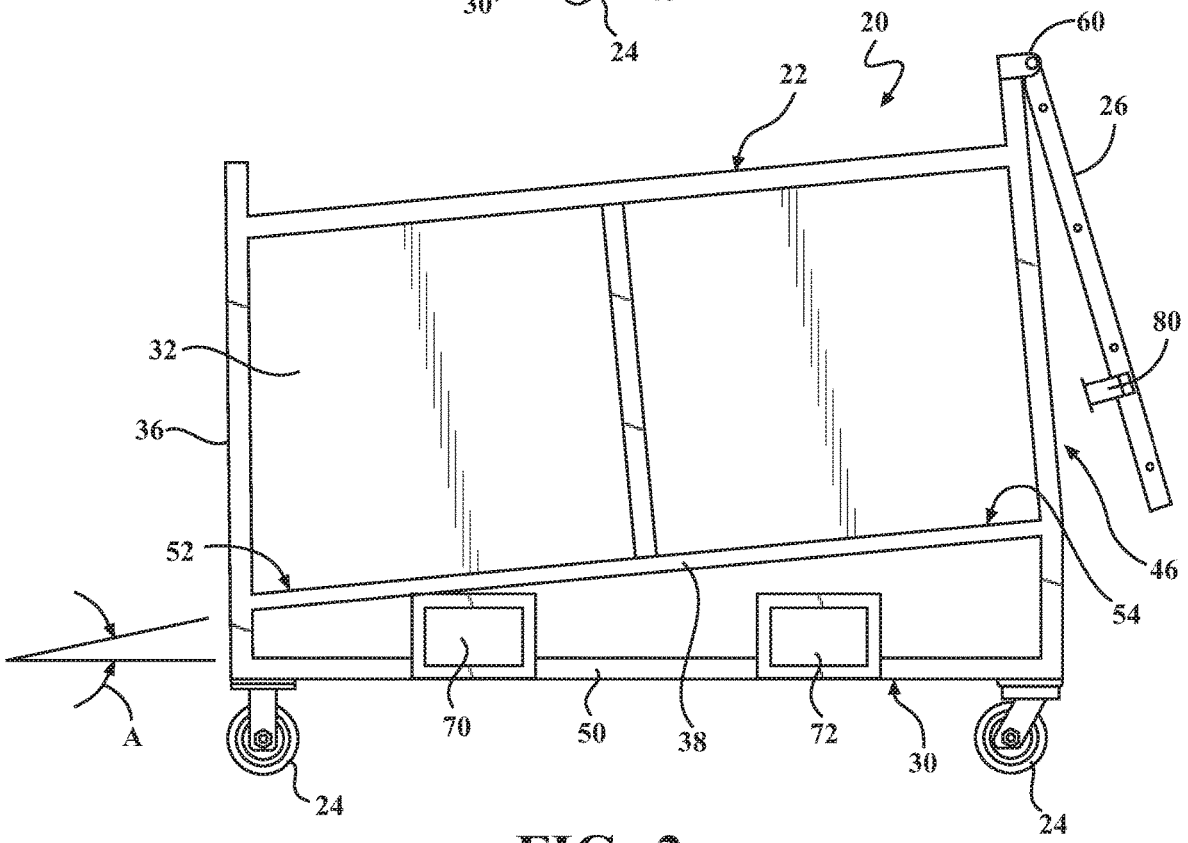
FIG. 2 is a front view of a forklift bin.
Figure 3:
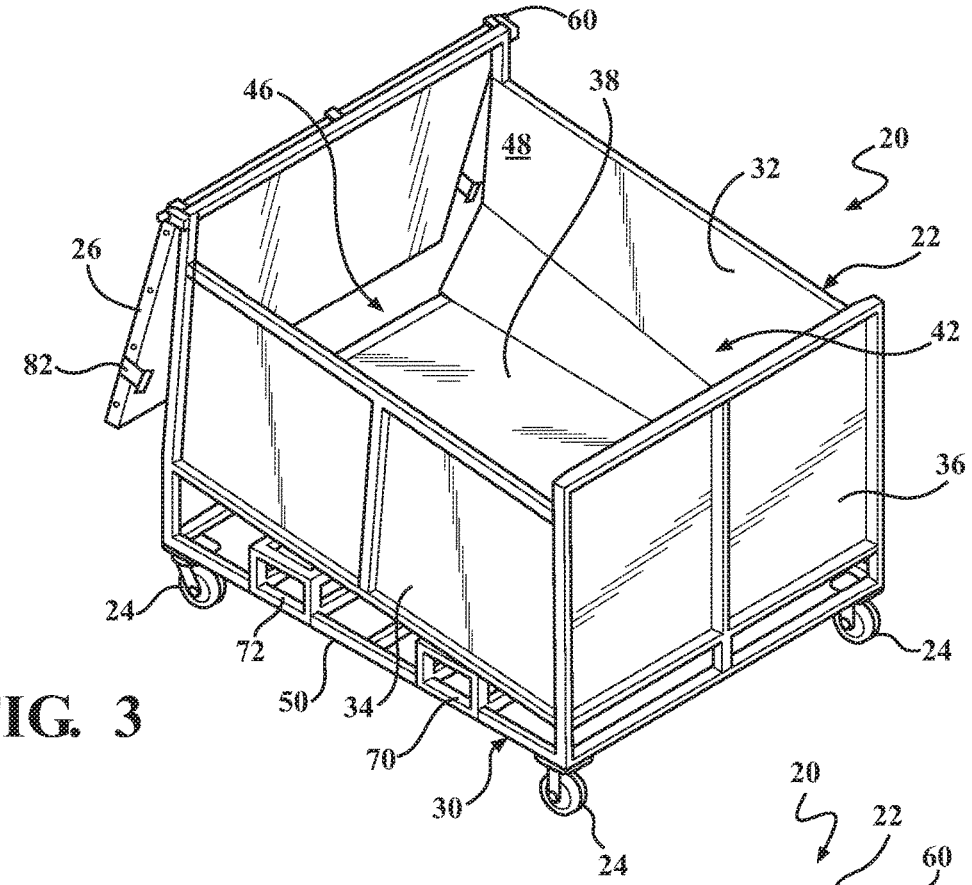
FIG. 3 is a schematic perspective view of a forklift bin.
Figure 4:
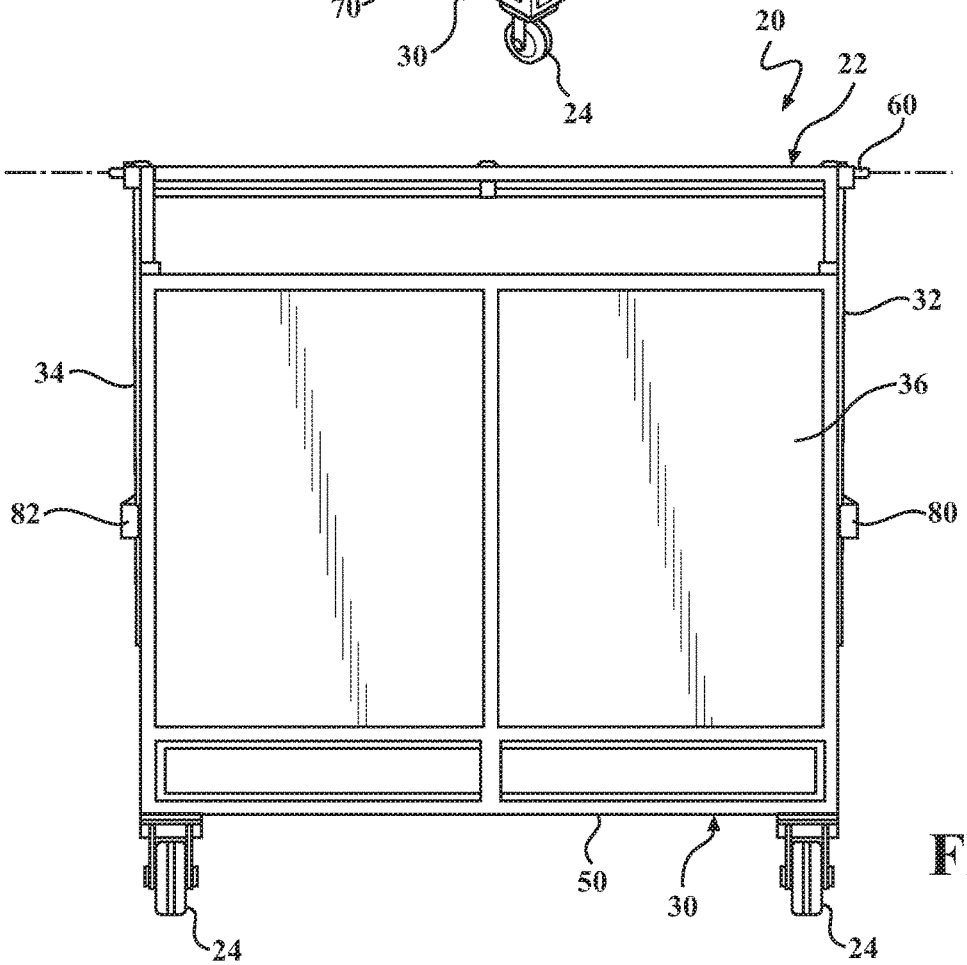
FIG. 4 is a side view of a forklift bin.
Figure 5:
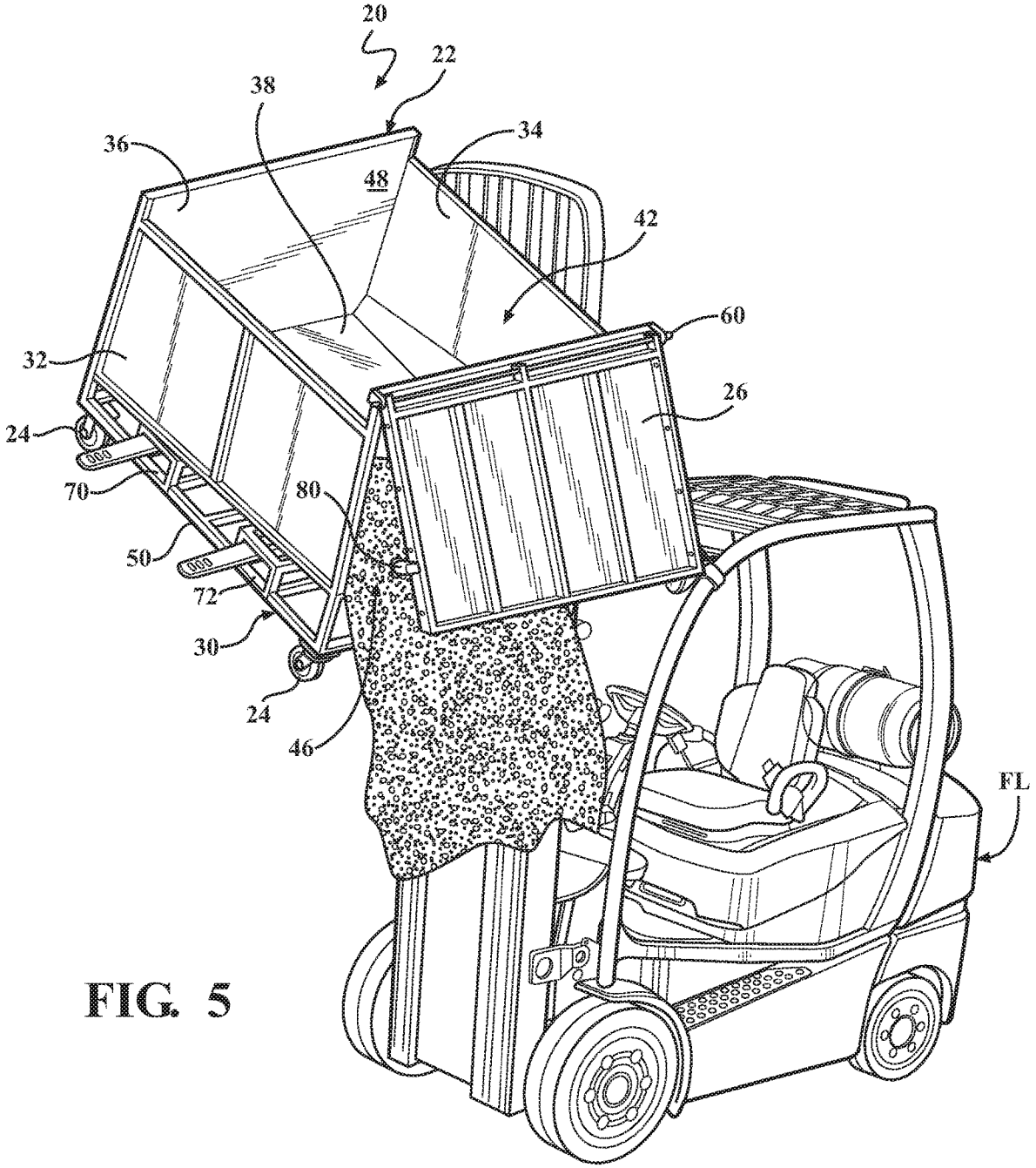
FIG. 5 is a schematic perspective view of a forklift bin being tipped by a forklift.

FIGS. 1-5 illustrate a forklift bin 20 operable to transport loads. FIG. 1 schematically illustrates the forklift bin 20. FIG. 2 is a front view of the forklift bin 20, FIG. 3 is another schematic view of the forklift bin 20, and FIG. 4 is a side view of the forklift bin 20. FIG. 5 schematically illustrates the forklift bin 20 being lifted and tipped by a forklift FL. Although the forklift bin 20 is of a particular geometry in the disclosed non-limiting embodiment, it should be appreciated that various geometries will also benefit herefrom.

The forklift bin 20 can include a body 22, multiple casters 24, and a swing door 26. The body 22 may support significant weight that, in one example, may be on the order of 1500 lbs. (680 Kg). The casters 24 may be manufactured of an alloy material or a non-alloy material, and may be mounted on a swivel to facilitate movement of the forklift bin 20.

The body 22 generally includes a frame 30, a first sidewall 32, a second sidewall 34, a back wall 36, and a bottom 38. The first sidewall 32, the second sidewall 34, the back wall 36, the bottom 38, and the swing door 26 can form an open top container 42 with an open side 46, and an open top 48. The swing door 26, as shown, is pivotally mounted to, and thus supported by, a remainder of the container 42 besides the swing door 26 for swinging movement with respect to the open side 46. In one example, the body 22 can be manufactured of 1018 mild steel.

Referring to FIG. 2, the frame 30 includes a base frame 50 to which the multiple casters 24 are affixed such that the base frame 50 is generally parallel to the ground. The bottom 38 can be non-parallel to the base frame 50 and thus non-parallel to the ground. In one disclosed non-limiting embodiment, the bottom 38 is angled with respect to the base frame 50 at an angle A of about seven (7) degrees away from the swing door 26 and the open side 46 (FIG. 2). That is, a low side 52 of the bottom 38 is opposite the swing door 26, and a high side 54 of the bottom 38 is adjacent to the open side 46 such that the bottom 38 slopes down away from the open side 46. Such arrangement facilitates retention of materials within the open top container 42 and thus the safe handling of relatively heavy weight materials contained therein.

The frame 30 can further include forklift openings 70, 72 that are generally parallel to a hinge axis 60 of the swing door 26, and perpendicular to the open side 46. The hinge axis 60 can be located adjacent to the open top 48 of the open top container 42 and between the sidewalls 32, 34 (FIG. 3). The hinge axis 60 in this disclosed non-limiting embodiment is formed by a 5/8 inch ×51 3/4 inch steel rod.

Now referring to FIG. 4, the swing door 26 may be retained to the sidewalls 32, 34 by locking devices 80, 82. The locking devices 80, 82, in this disclosed non-limiting embodiment, can include magnets so that the swing door 26 opens in response to the forklift bin 20 being tipped by a forklift FL as illustrated in FIG. 5 or other retention devices. The locking devices 80, 82 provide secure retention of the swing door 26 yet release in response to tipping of the forklift bin 20. When the forklift bin 20 is tipped to a first extent, the locking devices 80, 82 may initially withstand the application of a release force thereto, and thus continue to securely retain the swing door 26. However, when the forklift bin 20 is tipped to a second extent greater than the first extent, the locking devices 80, 82 may ultimately succumb to the application of the release force thereto, and thus release. In one disclosed non-limiting embodiment, the locking devices 80, 82 require about 15 KgF to release. For example, magnets that have strength to retain up to about 15 Kg weight but release upon application of about 15 Kg of weight can be used. In other words, when the forklift bin 20 is tipped to the second extent, the release force is approximately 15 Kg of weight. In one example, the forklift bin 20 need only be tipped about 40 degrees to release the material therein compared to about 140 degrees of a conventional forklift bin 20. In other words, the second extent is approximately 40 degrees. This allows an operator to safely remain within the driver's seat of the forklift FL during the entire dumping operation.

The use of the terms "a," "an," "the," and similar references in the context of the description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed is:

1. A forklift bin, comprising:

a frame;

a container affixed to the frame, the container including a swing door supported by a remainder of the container besides the swing door for swinging movement with respect to an open side of the container, and a bottom sloped downward away from the open side; and a locking device configured to releasably retain the swing door to the remainder of the container, whereby the swing door covers the open side, wherein the locking device includes a magnet configured such that:

when the forklift bin is tipped to a first extent, the magnet magnetically retains the swing door to the remainder of the container; and when the forklift bin is tipped to a second extent greater than the first extent, the magnet, by itself, magnetically releases the swing door from the remainder of the container for the swinging movement, whereby the swing door uncovers the open side.

2. The forklift bin as recited in claim 1, wherein the bottom is sloped downward away from the open side at about seven (7) degrees.

3. The forklift bin as recited in claim 1, wherein the container includes an open top.

4. The forklift bin as recited in claim 1, wherein the container includes a first sidewall, a second sidewall, a back wall, the bottom, and the swing door.

5. The forklift bin as recited in claim 4, wherein the open side is opposite the back wall, whereby the bottom is sloped downward away from the open side such that a low side of the bottom is adjacent to the back wall.

6. The forklift bin as recited in claim 4, wherein the frame includes a first and a second forklift opening.

7. The forklift bin as recited in claim 6, wherein the first and second forklift openings are parallel to a hinge axis of the swing door.

8. The forklift bin as recited in claim 4, wherein a hinge axis of the swing door extends between the first sidewall and the second sidewall.

9. The forklift bin as recited in claim 8, wherein the hinge axis is displaced from the bottom.

10. The forklift bin as recited in claim 1, wherein the second extent is approximately forty (40) degrees.

11. The forklift bin as recited in claim 1, wherein when the forklift bin is tipped to the second extent, a release force is approximately fifteen (15) Kg of weight.

12. A forklift bin, comprising:

a frame, the frame including a first forklift opening and a second forklift opening;

a container affixed to the frame, the container including a first sidewall, a second sidewall, a back wall between the first sidewall and the second sidewall, an open side between the first sidewall and the second sidewall opposite the back wall, a bottom that has a high side between the first sidewall, the second sidewall and the back wall, and a swing door adjacent to the high side of the bottom, the swing door supported by a remainder of the container besides the swing door for swinging movement with respect to the open side; and a pair of locking devices configured to respectively releasably retain the swing door to the first sidewall and the second sidewall, whereby the swing door covers the open side, wherein the pair of locking devices includes respective magnets configured such that:

when the forklift bin is tipped to a first extent, the magnets magnetically retain the swing door to the first sidewall and the second sidewall; and when the forklift bin is tipped to a second extent greater than the first extent, the magnets, by themselves, magnetically release the swing door from the first sidewall and the second sidewall for the swinging movement, whereby the swing door uncovers the open side.

13. The forklift bin as recited in claim 12, wherein the bottom is sloped downward away from the open side at about seven (7) degrees.

14. The forklift bin as recited in claim 12, further comprising casters mounted to the frame.

15. The forklift bin as recited in claim 12, wherein the swing door includes a hinge axis, the hinge axis parallel to the first forklift opening and the second forklift opening.

16. The forklift bin as recited in claim 12, wherein the second extent is approximately forty (40) degrees.

17. The forklift bin as recited in claim 12, wherein when the forklift bin is tipped to the second extent, a release force is approximately fifteen (15) Kg of weight.

* * * * *